United States Patent [19]

Cala

[11] 3,953,379

[45] Apr. 27, 1976

[54] MANUFACTURE OF IMPROVED AQUEOUS ALKALI METAL SILICATE-ALKALI METAL HYDROXYALKYL IMINODIACETATE COMPOSITIONS

[75] Inventor: Francis R. Cala, Somerville, N.J.

[73] Assignee: Colgate-Palmolive Company, New York, N.Y.

[22] Filed: Oct. 26, 1973

[21] Appl. No.: 410,222

[52] U.S. Cl. ..... 252/527; 252/173; 252/532; 252/535; 252/539; 252/540; 252/546; 252/551; 252/554; 252/558; 252/559; 252/DIG. 11; 252/DIG. 15

[51] Int. Cl.[2] ..... C110 3/08

[58] Field of Search ..... 252/527, 546, 540, 559, 252/DIG. 11

[56] References Cited

UNITED STATES PATENTS

| | | | |
|---|---|---|---|
| 3,332,880 | 7/1967 | Kessler | 252/161 |
| 3,726,797 | 4/1973 | Sundby et al. | 252/527 |
| 3,741,911 | 6/1973 | Shane | 252/527 |

*Primary Examiner*—Leland A. Sebastian
*Assistant Examiner*—E. Suzanne Parr
*Attorney, Agent, or Firm*—Norman Blumenkopf; Herbert S. Sylvester; Murray M. Grill

[57] ABSTRACT

Gelation and/or precipitation which normally result from the admixing of alkali metal silicates and alkali metal hydroxyalkyl iminodiacetates in aqueous media at elevated temperatures are prevented by raising the pH of the aqueous solution of alkali metal hydroxyalkyl iminodiacetate to 12.5 or more before admixing with the alkali metal silicate. The process described makes a homogeneous mixture of the components and allows the production of a crutcher mix which does not block lines or spray nozzle orifices in the production of spray dried detergent compositions. The preferred silicate is sodium silicate of an $Na_2O:SiO_2$ ratio of 1:2 to 1:2.4, the preferred iminodiacetate is disodium 2-hydroxyethyl iminodiacetate and a preferred compound for adjusting the pH is sodium carbonate, all of which are useful in the production of built nonphosphate heavy duty synthetic organic detergent compositions.

16 Claims, No Drawings

MANUFACTURE OF IMPROVED AQUEOUS ALKALI METAL SILICATE-ALKALI METAL HYDROXYALKYL IMINODIACETATE COMPOSITIONS

This invention relates to the manufacturing of aqueous compositions containing alkali metal silicate and alkali metal hydroxyalkyl iminodiacetate. More particularly, it relates to producing such compositions with little or no gelation or precipitation of the silicate or decomposition products thereof. A related aspect of this invention is in the utilization of such gel- and precipitate-free alkali metal silicate-alkali metal hydroxyalkyl iminodiacetate compositions in the manufacture of detergents such as spray dried detergent beads, wherein transport of the detergent composition solution or slurry and/or spraying thereof through restricted orifices is/are facilitated due to the absence of gel or precipitate which would otherwise be present to hinder flow or block spray drying nozzles.

During the manufacture of crutcher mixes or other solutions or dispersions of detergent composition components including alkali metal silicates and alkali metal hydroxyalkyl iminodicarboxylates it was noted that gelatinous or particulate materials have been produced which tended to block spray drying nozzles and otherwise interfere with the processing of the detergent constituents or the final compositions. Such precipitates are highly objectionable from a processing standpoint and also, since they evidently are produced from a component of the composition, are detrimental because they diminish the proportion of such component present. Additionally, an insoluble reaction product, if deposited on clothes washed with the detergent composition, can create a harsh or boardy feel which is objectionable to the user of such products.

Investigation has established that the precipitate or gel includes silicon and apparently results from a reaction of the alkali metal silicate with alkali metal hydroxyalkyl iminodiacetate. The production of such precipitate can be avoided by omitting the iminodiacetate compound from the aqueous medium and sometimes, if such omission is not practicable, adding counter-acting chemicals, such as pentasodium tripolyphosphate or sodium sulfate to the aqueous solution or crutcher mix. In many instances it is undesirable to omit the iminodiacetate, which, it has been found, is an excellent biodegradable, non-toxic, organic builder salt for synthetic organic detergents of the anionic and nonionic types. Also, in order to comply with governmental regulations it is frequently undesirable to include phosphates in the detergents. Accordingly, efforts have been made to find a method for re-dispersing or preferably, initially avoiding the production of gels and/or precipitates. Such a method should be commercially practicable, inexpensive, non-interfering with other constituents of detergent compositions and readily adaptable to being practiced in normal detergent production crutchers and other mixing equipment.

The present invention solves the described problem in a simple, inexpensive, effective and highly desirable manner. Unexpectedly, it has been found that if the pH of an aqueous alkali metal hydroxyalkyl iminodiacetate solution is elevated above its normal level, usually to 12.5 or higher and preferably to the range of 12.5 to 13.5, the objectionable gels and precipitates are not produced at the usual elevated temperatures used for crutching and at which the crutcher mix is pumped to spray nozzles for drying to bead form. This is so when the silicate and/or iminodiacetate are initially present with other materials and when they are used alone. It is true at elevated temperatures such as are desirably employed in the preparations of crutcher mixes for spray drying. At lower temperatures, while a beneficial result is often obtained, some precipitate or floc may still result. The result is surprising because it does not appear that the final pH of the composition is the determinative factor; rather, the pH of the iminodiacetate at the time at which it is brought into contact with silicate has been found to be important.

In accordance with the present invention a method for the manufacture of aqueous alkali metal silicate-alkali metal hydroxyalkyl iminodiacetate compositions comprises admixing the alkali metal hydroxyalkyl iminodiacetate at an elevated pH with the alkali metal silicate and producing therefrom an aqueous composition containing the alkali metal hydroxyalkyl iminodiacetate and the alkali metal silicate wherein the gelation and/or precipitation which would normally be obtained from admixing of the composition components with the pH of the alkali metal hydroxyalkyl iminodiacetate unelevated is prevented or decreased. In preferred embodiments of the invention the alkali metal silicate is sodium silicate of an $Na_2O:SiO_2$ ratio in the range of 1:2 to 1:2.4, the iminodiacetate is disodium 2-hydroxyethyl iminodiacetate, both are in aqueous solution before admixing and the pH adjusting chemical is sodium carbonate. Also best improvements in preventing precipitation obtain when control and treated crutcher mixes at elevated temperatures, e.g., 50° to 80° C., are compared. After admixing and compounding with other synthetic organic detergent composition constituents it is preferred that the mixture be spray dried to solid bead form.

The alkali metal silicates of the present invention are those which are water soluble and useful as builders for synthetic organic detergents in heavy duty detergent compositions. Although their building actions may not be as effective with anionic detergents as that of pentasodium tripolyphosphate, in detergent compositions designed to be phosphate-free or low in phosphate content the silicates do exert pH adjusting (alkalizing) effects, help to counteract water hardness and have both an independent detersive effect and the property of improving the effect of the anionic detergent utilized. When particular nonionic detergents are employed with the silicates and other heavy duty detergent composition constituents a product can be made which is comparable to the previously highly superior phosphate-built linear alkyl benzene sulfonate (LAS) compositions. Additionally, the silicates have a corrosion inhibiting effect.

The silicates employed are water soluble. Of the inorganic silicates those which are water soluble are the silicates of alkali metals, e.g., sodium potassium. Silicates of $M_2O:SiO_2$ ratios are available in the range of 1:1 to 1:4 but for practical purposes those which are used for detergent compositions are generally of such ratios of 1:1.6 to 1:3, preferably 1:2 to 1:2.4 and most preferably about 1:2.0. In the preceding formulas M stands for alkali metal, preferably sodium or potassium. The sodium silicates are preferred for use in solid or particulate detergent products and the potassium silicates are generally preferred in liquid compositions, although, especially when mixtures are utilized, either may be employed in both types of compositions.

The various silicates described are usually supplied as aqueous solutions although it is within the present invention to employ solid or particulate silicates too, normally after dissolving them in water. The concentrations of the aqueous solutions will usually be those which are as high as possible and at which the solution is readily pumpable. Normally, from 20 to 50% by weight of sodium silicate will be employed, preferably from 35 to 45% by weight thereof. With respect to a preferred silicate, that of $Na_2O:SiO_2$ ratio of 1:2.0, the concentration will most preferably be from 40 to 45%.

The hydroxyalkyl iminodicarboxylates of this invention are water soluble, are excellent builders for synthetic organic detergents and have desirable sequestering actions against water hardness ions, such as calcium and magnesium, which otherwise might interfere with detersive effects of the organic detergent. The hydroxyalkyl iminodicarboxylates often employed are alkali metal salts, usually diacetates, although other solubilizing cations may also be present, at least in partial substitution for the alkali metal salts. Of the alkali metal salts the sodium and potassium salts are preferred, with the sodium salt being that of greater preference for solid or particulate compositions and the potassium salts being better for liquid preparations. Exemplary of other solubilizing cations are mono-, di- and trialkanolammonium and mono-, di- and trialkylammonium, where the alkyls and alkanols are lower, usually of 1 to 4 carbon atoms and preferably of 1 to 3 carbon atoms, most preferably being of 2 carbon atoms. Examples of such materials are di- triethanolammonium 2-hydroxyethyl iminodiacetate and di-monoisopropylammonium 3-hydroxy-n-propyl iminodiacetate. Di-ammonium iminodiacetates substituted with hydroxyalkyls are also used.

The hydroxyalkyl of the hydroxyalkyl iminodiacetate is hydroxy-lower alkyl wherein the lower alkyl is of 1 to 4 carbon atoms, preferably of 2 to 3 carbon atoms and most preferably, is ethanol. Although the hydroxyl does not have to be terminal on the ethyl, for best effects that positioning is desirable.

The iminodiacetates have been characterized as alkali metal hydroxyalkyl iminodiacetates but it should be understood that although these are the preferred materials employed other lower carboxylates may also be improved for addition to silicates by the method of this invention. Also, it is contemplated that the starting materials may be the free acids or monoacetates since these will be converted to the alkali metal hydroxyalkyl iminodiacetates during the process of pH adjustment. Thus, at some time during the process an alkali metal hydroxyalkyl iminodiacetate will be present at its normal pH and that pH will then be elevated by subsequent addition of alkalizing material.

Due to the number of different hydroxyalkyl iminodiacetates that are included within the constituents of this invention and the variations in solubilities thereof the preferred solutions of such materials employed will generally contain from 20 to 80% of the alkali metal hydroxyalkyl iminodiacetate. Preferably, the concentration will be from 40 to 60% and most preferably it will be about 50%. When the solutions of the iminodiacetate and silicate are to be subsequently dried it will usually be most desirable to have as high concentrations of the active materials as possible in the solutions so as to avoid the necessity for removals of larger proportions of moisture in the drying process. However, it is also desirable that the solutions be sufficiently fluid to provide good mixing during pH adjustment.

In producing the silicate-iminodiacetate mix the materials themselves may be admixed or may be present in other constituents of the final composition. Admixings may be by any method, with the iminodiacetate being added to the silicate solution or vice versa or by adding both constituents at the same time to a mixing vessel. However, it is frequently preferred to add the solution of iminodiacetate which has previously been raised to the desired elevated pH, to a solution of the silicate.

Before admixing of the iminodiacetate with the silicate the pH of the solution should be adjusted so that it is higher than normal, i.e., at an elevated level. The normal pH of the iminodiacetate made by the acid route will be in the range of 9 to 10, usually about 9.5, and this is desirably increased to over 12, preferably to a pH of 12.5 or more, e.g., 12.5 to 13.5. If the pH is elevated as described the admixing of the aqueous iminodiacetate solution with an aqueous silicate solution may be effected without any increase in insolubles or gel content. In some cases, the silicate solution may initially be slightly cloudy, before pH adjustment, possibly due to very minor proportions of silica being present therein but, while the alkalizing processes may diminish the cloudiness somewhat, usually it will not clarify the solution entirely. However, it does not increase the proportion of silica or silicate degradation products.

The adjustment of the pH may be effected with various compounds, including salts and alkalis such as carbonates, hydroxides, oxides, and borates or hydrates thereof, and various other suitable salts and mixtures thereof. Normally, the major requirements are that the salt be soluble in water, in the silicate solution and in the medium treated and be capable of raising the pH to the desirable level with the addition of tolerable quantities of the treating chemical. Usually the salts and alkalis will be of alkali metals, e.g., sodium, potassium, or of ammonia. Exemplary of the desirable pH adjusting chemicals are sodium carbonate, which can be a useful constituent of detergent compositions in which the silicate-iminodiacetate mixture is to be included, sodium hydroxide, ammonium hydroxide and suitable sodium borates. Phosphates, too, can be included but because in detergent compositions which are to be phosphate-free it may be undesirable to utilize even small quantities of trisodium phosphate or other suitable phosphate to regulate the pH, these are usually avoided. Organic compounds such as triethanolamine, trimethylamine and other suitable lower amines and alkanolamines, (alkyls and alkanols of 1–4 carbon atoms) and salts thereof may also be employed, as may be the various alkali metal and ammonia salts and bases. Of all the possible pH-regulating materials, the most preferred is sodium carbonate because it is a useful constituent of detergent compositions which may be based on iminodiacetates and silicates.

The above description of the pH-adjusting method is with respect to elevating the pH of aqueous solutions of the iminodiacetate, which is preferably disodium 2-hydroxyethyl iminodiacetate. However, it is possible to include the pH-adjusting chemical with a solid form of the iminodiacetate and add such mixture to the silicate solution. thus, powdered alkaline material may be mixed with powdered iminodiacetate, preferably as the hexahydrate of disodium 2-hydroxyethyl iminodiacetate, and such mixture may be admixed with the aqueous silicate solution. While such methods are feasible, it is preferred to admix solutions of the silicate and iminodiacetate materials.

The temperature at which the iminodiacetate and silicate are admixed will usually be elevated crutcher temperatures, e.g., 50° to 80° C. At lower temperatures, if the admixing is effected without elevating the pH a precipitate will normally appear whereas at the higher temperatures the formation of a gel will be encountered. When the pH of the iminodiacetate solution is increased as described neither precipitate or gel is produced at the elevated crutcher temperatures. At lower temperatures, e.g., 20° to 49° C., while some particulate matter may separate out it is not the objectionable gel or floc that results when the pH is lower, e.g., 9.4. It seems that at the lower temperatures no iminodiacetate hydrate precipitates but some silica does separate, although it is much less than at lower pH's.

The mixer utilized may be of any suitable design but it is normally preferred that the conventional soap crutcher or detergent mixer, used to mix, break up and disperse detergent materials prior to spray drying, should be employed. However, instead of such mixers, others may be substituted providing only that sufficient agitation is obtainable to maintain the mix uniform and to distribute the high pH iminodiacetate throughout the mix as it is added. Before or after the recited admixing, other constituents of a final composition may be present or may be added, including synthetic organic detergents of the nonionic and/or anionic types, supplementary builders, fillers, anti-redeposition agent gums and adjuvants, in preparation for spray drying or other drying of the mixture to solid or particulate form. Various suitable materials for making such compositions have been described at length in the literature and will not be repeated in great detail here. For a listing of these and proportions thereof often found to be useful, see my copending patent application entitled Particulate Silicate-Hydroxyalkyl Iminodiacetate Built Detergent Composition of Improved Properties, filed the same day as the present application, which is incorporated by reference herein.

The anionic detergent is preferably a linear higher alkyl benzene sulfonate of 12 to 15 carbon atoms in the alkyl group, preferably of 13 or about 13 carbon atoms, with the linear alkyl substantially terminally joined to the phenyl group. A minor proportion of the alkyls may be joined to the 2- or 3-carbon but generally the amount thereof will be less than 30% of the alkyls and most of that will be on the 2-carbon. The detergent salt will normally be a salt of sodium or potassium and although other salt-forming metals and cationic radicals may be employed they will usually be present only in minor proportions. In addition to the LAS detergents described, other anionics of known types, such as the branched chain higher alkyl benzene sulfonates, the higher alkyl sulfates, the higher fatty acid monoglyceride sulfates, the higher olefin sulfonates, the higher alkyl sulfonates, the sulfated pheoxypolyoxyethanols and the higher fatty acid soaps, may be employed. The alkyls and higher fatty acyl groups thereof will generally be of 12 to 18 carbon atoms and the salt-forming ions thereof will preferably be alkali metals, although alkanolamines and alkylamines may also be utilized, e.g., as in triethanolamine lauryl sulfate. Among preferred anionic materials are the sulfated nonionics and particularly preferred are the sulfated higher fatty alkanol polyoxyethylene ethanols of about 12 to 15 carbon atoms per alkanol and of 3 to 15 moles ethylene oxide, more preferably of 3 to 10 moles thereof, which act as detergents or wetting agents.

Instead of the anionic detergents or in addition to them nonionic detergents may also be utilized. These include condensation products of higher fatty alcohols with polyoxy-lower alkylene glycols, such as Neodol 45-11, Plurafac B-26 and Alfonic 1618-65, in which the alkylene is of 2 to 3 carbon atoms, preferably being ethylene. Also useful are the block copolymers of propylene glycol, propylene oxide and ethylene oxide, such as the Pluronics, e.g., Pluronic L-44 and Pluronic F-68; and the middle alkyl phenyl polyoxyethylene ethanols, such as those sold as Igepals. Normally the content of nonionic detergent, such as those which are condensation products of higher fatty alcohol and alkylene oxide, e.g., the Neodols of 12 to 15 carbon atoms in the higher fatty alcohol and including from 3 to 15, preferably 10 to 15 moles of alkylene oxide per mole of fatty alcohol, will be less than the anionic detergent content of the product and preferably will be about one-half or less of such content, e.g., 10 to 50% thereof.

The detergent compositions, including the hydroxyalkyl iminodiacetate and silicate, will also normally contain an alkali metal carbonate, e.g., sodium carbonate, and an organic gum anti-redeposition agent, e.g., sodium carboxymethyl cellulose, polyvinyl alcohol, hydroxymethylethyl cellulose, polyvinyl pyrrolidone, polyacrylamide or hydroxypropylethyl cellulose. Fillers such as sodium sulfate and/or sodium chloride may also be present, together with a small proportion of moisture in the dried product. Proportions of the various components in final spray dried, drum dried, granulated, powdered, ribbon, flake or other form of dried detergent will normally range from 5 to 20 parts of the anionic detergent; 1 to 8 parts of nonionic detergent; 10 to 35 parts of hydroxyalkyl iminodiacetate; 5 to 30 parts of alkali metal silicate; 4 to 20 parts of alkali metal carbonate; 0.3 to 3 parts of organic gum anti-redeposition agent; 1 to 15 parts of moisture and the balance, usually from 5 to 40 parts, of alkali metal sulfate or alkali metal chloride.

With the other components of the detergent there may be present any suitable adjuvants such as sanitizers, e.g., trichlorocarbanilide; coloring agents, e.g., dyes and pigments; foam improvers, e.g., lauric diethanolamide; foam depressants, e.g., silicones; fungicides, e.g., polyhalosalicylanilides; antioxidants, e.g., stannic chloride; stabilizers; chelating agents; optical bleaches or fluorescent brighteners; solvents; hydrotropes; and perfumes. The total adjuvant content will usually not exceed 20% of the composition and normally will be less than 10% and preferably will be less than 5% thereof, with none of the constituents except the solvent being more than 5%, preferably each being less than 2% and most preferably, less than 1% thereof.

Less stable components of the particulate detergents, or those which might interfere with drying may be post-added. For example, perfumes and liquid nonionic detergents may be added after drying is completed. Preferably, all of the salts employed will be sodium salts.

It is within the invention to utilize the process to make other detergent compositions and different products, too. If it is not considered necessary or desirable to formulate non-phosphate, non-NTA products, a phosphate, such as sodium or potassium tripolyphosphate, may be substituted for a proportion of the silicate and carbonate content, e.g., 10 to 50% thereof, and NTA may be substituted for a proportion of the iminodiacetate content, e.g., 10 to 50% thereof.

After admixing of the silicate and iminodiacetate solutions, either with or without compounding with the other components of the detergent composition, the mix may be spray dried to particulate form. When spray drying is effected hydrotropes may also be employed but usually they are omitted.

Analyses of the precipitates and gels produced when the pH of the iminodiacetate is not elevated before admixing with the silicate solution indicate that the material separating out from the solution is primarily silica, silicic acid or silica gel. While the gels interfere with pumping and transport of the mix, whether it is of silicate and hydroxyalkyl iminodiacetate alone or of such materials with additional detergent composition components, both gels and small particles and the combination thereof will tend to cause blockages of small orifices through which they might otherwise have passed. Principally, such orifices will be those in spray nozzles or equivalent obstructions which will be small passages through which the crutcher mix is to be moved. Such passageways may be of cross-sectional areas equivalent to a circular passage of one millimeter to five mm. in diameter and despite spray pressure of 200 to 1,000 lbs./sq. in. such passageways are blocked by the particles of precipitate and are often at least momentarily obstructed by the gel. This is so even when the temperature of the crutcher mix is raised so as to help to dissolve most of the detergent constituents. However, when the hydroxyalkyl iminodiacetate is initially treated with the alkalizing agent to raise the pH to the desired range flow through orifices and restricted passageways occurs readily without even momentary blockages.

The detergent compositions made, in particulate spray dried bead form, when tested by standard wash tests and in practical automatic laundry tests, are found to be essentially equivalent to similar compositions based on pentasodium tripolyphosphate and trisodium nitrilotriacetate builders. No perceptible precipitate or gel is formed during the washing process. The clothing washed is white and clean and is not noticeably harsher to the touch than other such items similarly washed with control detergents. The silicate component has no eutrophying effect on waters into which the wash water is discharged and the hydroxyalkyl iminodiacetate constituent is readily biodegradable.

Instead of being incorporated in heavy duty synthetic organic detergents the present mixtures of silicate and iminodiacetate may be formulated in light duty detergents, with the silicate acting as a corrosion preventive material of some water softening and sequestering power and the iminodiacetate serving to build the detersive action of the synthetic organic detergent component. The silicate-iminodiacetate solution may be used immediately after manufacture or may be stored for periods up to 24 hours and more, although it is preferred to utilize it within an hour after it is produced as a stock solution for the manufacture of various compositions. If desired, the mix may be spray dried without the addition of any other materials and may be post-added or otherwise formulated with other detergent constituents and with surface active or chelating products intended for other applications.

The following examples illustrate but do not limit the invention. Unless otherwise mentioned all parts are by weight and all temperatures are in ° C.

EXAMPLE 1

| | Parts by Weight |
|---|---|
| * Higher fatty alcohol poly-lower alkoxylated lower alcohol sulfate, sodium salt | 5 |
| ** Higher fatty alcohol poly-lower alkoxylate detergent | 3 |
| Linear tridecyl benzene sulfonate, sodium salt (90% active ingredient) | 15 |
| 2-Hydroxyethyl iminodiacetic acid, disodium salt (53% solids content aqueous solution of a pH of 9.4) | 30 |
| Aqueous sodium silicate solution ($Na_2O:SiO_2$ = 1:2; solids content = 44%) | 36 |
| Sodium carbonate, anhydrous | 13 |
| Sodium carboxymethyl cellulose (85% active ingredient) | 0.7 |
| Sodium chloride | 20 |
| Water | 7 |

* Neodol 25-3S, a higher fatty alcohol polyethoxylate sulfate, sodium salt, made by Shell Chemical Company, wherein the higher fatty alcohol is of 12 to 15 carbon atoms and there are present three moles of propylene oxide per mole of higher fatty alcohol.

** Neodol 45-11, a higher fatty alcohol polyethoxylate made by Shell Chemical Company, wherein the higher fatty alcohol is of 14 to 15 carbon atoms and there are present eleven moles of ethylene oxide per mole of higher fatty alcohol.

Three parts of the sodium carbonate are dissolved in about four parts of water and, utilizing a separate mixer, are admixed with the 2-hydroxyethyl iminodiacetic acid, disodium salt solution at 65° C., so as to raise the pH thereof to 12.7. The sodium silicate solution is added to a detergent composition crutcher and hydroxyethyl iminodiacetate solution, at the elevated pH, is added to the silicate, with stirring. No precipitation or gelation is noted, although the pH drops below 12. Subsequently, the rest of the carbonate is added, followed by the anionic detergents, nonionic detergent and sodium chloride. The sodium carboxymethyl cellulose is dissolved in the remaining water and is admixed with the rest of the crutcher mix. After mixing in the crutcher for a period of five minutes after addition of all materials, the crutcher mix, free of precipitates and gels, is pumped by a Triplex pump at a pressure of 600 lbs./sq. in. through a plurality of spray nozzles, each of which has a orifice of about one millimeter diameter, into the top of a countercurrent spray drying tower wherein the falling droplets of detergent composition are dried in heated drying air passing upwardly through the tower at a $T_1$ temperature of about 400° C. (final temperature of about 130° C.), to a moisture content of 3%. The resulting product, in the form of spray dried globules, is screened and sized so that the particles thereof pass through a No. 8 sieve, U.S. Standard Sieve Series and rest on a No. 100 mesh screen. The products resulting have 0.2% of perfume sprayed onto them and are mixed with a finely divided light clay flow improving agent, such as that sold to the detergent industry under the trade name "Satintone", with spraying and mixing occurring in a tumbling drum. Then the product is packaged and is ready for use.

In use it is found that the above composition is comparable in detergency with high phosphate compositions based on 15 to 25% of active anionic detergent and 35 to 45% of pentasodium tripolyphosphate. Yet, the product is non-eutrophying and does not contain any phosphates nor does it contain unusual quantities of surface active agents, detergents, builders or anti-redeposition compounds.

Utilizing standard concentrations for detergents in automatic washing machines, 0.15% of spray dried detergent, the product is tested and found to be of acceptable to superior washing ability in hot and cold water, in hard and soft water and when tested against varying types of soils from clay soil to phospholipid or sebum soils, as compared to a phosphate-containing (previously) commercially successful detergent. No signs of gel or precipitate are noted in the product, wash water, laundry or effluent from the washing machine.

When the above formula is modified by increasing the nonionic detergent content of the product to eight parts, and increasing the hydroxyethyl iminodiacetate solution content to 40 parts, a similarly satisfactory product is obtained. This is also the case when the amount of sodium carbonate is varied over the range of 8 to 20%, the sodium carboxymethyl cellulose is increased to 1.5%, the sodium chloride is replaced by sodium sulfate, the sodium silicate solution is raised to 50 parts and the anionic detergent content is diminished to 12 parts. While all such changes may be made to obtain a comparable product, any one of them may be made in the basic formula and the product resulting is still satisfactory.

EXAMPLE 2

In laboratory experiments addition of iminodicarboxylate to silicate and of silicate to iminodicarboxylate, with and without pretreatment of the iminodicarboxylate to raise the pH thereof to 12.5 or higher, are effected and the natures of the compositions produced are noted.

358 Parts of 2-hydroxyethyl iminodiacetate, disodium salt, at a concentration of 53% in water, a pH of 9.4 and a temperature of 65° C., are added to each of three containers. To the first of these 0.2 part of sodium silicate ($Na_2O:SiO_2$ = 1:2) at a concentration of 44% in water and at room temperature is added and it is noted that small white balls are formed. Similarly, in the second container, after the addition of 0.4 part of the silicate additional ball formation is seen. In the third container 516 parts of the silicate are added and a gel of all the material contained is produced.

When essentially the same experiment is repeated, except for initial adjustment of the pH of the iminodicarboxylate solution to 13.4 with sodium carbonate (and in other experiments, with sodium hydroxide) clear solutions are noted after the addition of 0.2 part, 1.5 parts and 516 parts of the silicate. In fact, even on cooling down to 29° C. the solutions remain clear.

In another set of experiments wherein the same iminodicarboxylate is added to the same sodium silicate, when 358 parts of the iminodicarboxylate at 53% concentration, a pH of 9.4 and at room temperature are added to 516 parts of the 1:2 $Na_2O:SiO_2$ sodium silicate in 44% aqueous solution, a large spongy mass forms. On the contrary, when the pH of the hydroxyethyl iminodiacetate is adjusted to 12.7 with sodium carbonate before addition of the silicate a clear solution is produced, from which only a small amount of floc separates upon cooling.

In similar tests in which the temperatures of the materials are initially higher, e.g., 70° C. and the temperatures of both materials are elevated so that the final solution is at 60°–70° C., when the pH is at 12.7 and when it is at 13.4 the solution remains clear. At lower temperatures, e.g., 30° C., some floc forms at the higher pH's but it is considerably less than that which forms at pH's of 8, 9.4 and 10.

The results of the above experiments are also obtained when they are run with other detergent composition constituents present, such as the components of the formulation of Example 1, in the proportions described therein. Comparable results are also obtained when different silicates are utilized, e.g., one of an $Na_2O:SiO_2$ ratio of 1:2.4 and when other hydroxy-lower alkyl iminodiacetates are employed, e.g., 1-hydroxyisopropyl iminodiacetate, potassium salt. Such results are obtainable when the carboxylic acid of the iminodicarboxylate acid is of 2 to 3 carbon atoms, e.g., acetic or propionic, and when the salt forming cation is an alkali metal, e.g., sodium, potassium.

From the work described in this example it appears that when the pH of the hydroxyethyl iminodiacetate to be utilized is less than 12 it is desirable to adjust it to 12 or more, preferably 12.5 to 13.5, to avoid the production of gels or insoluble matter in crutcher mixes. The invented processes are especially effective with the silicate and iminodiacetate at elevated temperatures before mixing and if one of the constituents is at such elevated temperature.

EXAMPLE 3

| | Parts by Weight |
|---|---|
| Linear tridecyl benzene sulfonate, sodium salt (56% solids aqueous solution, with 86% of the solids being active ingredient and the balance being essentially sodium sulfate, with a minor proportion of tridecyl benzene) | 16.5 |
| 2-Hydroxyethyl iminodiacetic acid, disodium salt (53% solids content aqueous solution of a pH of 13) | 17.6 |
| Sodium carbonate, anhydrous | 7.1 |
| Sodium carboxymethyl cellulose (65% active ingredient) | 0.6 |
| Aqueous sodium silicate solution ($Na_2O:SiO_2$ = 1:2; solids content = 44%) | 19.5 |

-continued

| | |
|---|---|
| Optical brighteners (Tinopal RBS 200, Tinopal 5BM Conc., and Stilbene No. 4 in 1:7:2 ratio) | 1.0 |
| Sodium sulfate, anhydrous | 29.2 |
| Aqueous Neodol 25-3S solution (50% solids, of which 80% is active ingredient, the balance being essentially sodium sulfate) | 7.0 |
| Neodol 45-11 | 1.5 |

A particulate solid spray dried detergent is made by mixing together in a detergent crutcher the above components in the order given. Additions of all but the last two constituents are made at approximately room temperature and each is blended in thoroughly before the next is admixed. The pH of the crutcher mix just before addition of the sodium silicate solution is over 12.5. No precipitation or gelation results upon admixing of the silicate with the hydroxyethyl iminodiacetate in the crutcher mix. Before additions of the Neodols the crutcher mix is heated to a temperature of about 68° C.

The crutcher mix is spray dried to a moisture of 4%, using the spray conditions described in Example 1. No blockings of the spray nozzles or pipes at restrictions result. No precipitation or gelation occurs after the additions of such other materials nor are these conditions created in the spray droplets before drying or afterward. The product resulting is screened and sized as described in Example 1 and is treated and packaged in the same manner. It is non-eutrophying particulate detergent and is comparable in detergency with commercial phosphate-built products. Similar desirable effects are obtained when the linear tridecyl benzene sulfonate is replaced by the same proportion of sodium linear dodecyl benzene sulfonate, sodium lauryl sulfate, sodium higher olefin sulfonate, sodium paraffin sulfonate, sodium higher alkane sulfonate and others of the previously named anionic synthetic organic detergents, and mixtures thereof. Similarly, the Neodol 25-3S may be replaced by such products. Other alkali metal salts of the detergents and builders may also be substituted, such as the corresponding potassium salts, although the proportions thereof are normally held to less than those of the sodium salts so as to promote flowability and non-tacky properties of the product.

When the proportions of components are changed, as by doubling or halving the contents of the anionic detergent and/or the iminodiacetate, while maintaining them within the described range of proportions previously given, properties of the product change accordingly, with diminutions as the proportions of the detergent(s) and iminodiacetates diminish and improvements as they increase. However, the described products are useful non-eutrophying detergents. Similar changes in product properties are made as the proportions of builder salts are increased or decreased, within the ranges given. The properties referred to include non-tackiness and flowability after storage for appreciable periods of time but also relate to friability, uniformity, non-laziness and non-dustiness.

EXAMPLE 4

| | Parts by Weight |
|---|---|
| Linear tridecyl benzene sulfonate, sodium salt (56% solids aqueous solution, with 86% of the solids being active ingredient and the balance being essentially sodium sulfate, with a minor proportion of tridecyl benzene) | 15.7 |
| 2-Hydroxyethyl iminodiacetic acid, disodium salt (53% solids content aqueous solution of a pH of 13) | 34.8 |
| Sodium carbonate, anhydrous | 0.5 |
| Sodium carboxymethyl cellulose (65% active ingredient) | 6.7 |
| Aqueous sodium silicate solution ($Na_2O:SiO_2$ = 1:2; solids content = 44%) | 18.3 |
| Optical brighteners (as in Example 3) | 1.0 |
| Sodium sulfate, anhydrous | 21.6 |
| Neodol 45-11 | 1.4 |

The above formula is processed as described in Example 3 with the exception that no crutcher heat is employed, the order of addition of materials is as given and the Neodol 25-3S is omitted. The product resulting is a good particulate detergent of properties like those previously exemplified. When other builder and filler salts are utilized in place of minor proportions of the silicate and sulfate, e.g., sodium silicates of 1:2.4 and 1:2.7 $Na_2O:SiO_2$ ratios, and sodium chloride, good detergents of the desired properties also result, which is also the case when the CMC is replaced by polyvinyl alcohol, hydroxypropylmethyl cellulose or methyl cellulose. When the Neodol 45-11 is replaced with the other mentioned nonionic detergents acceptable products are also obtainable. None of the described products produces the undesirable gels or precipitates upon mixing of the silicate and the iminodiacetate, and they do not block pipe lines or spray nozzles. This is also the case when the other iminodiacetates described in these examples and in the specification and any of the sodium silicate solutions also so described are mixed together, providing that the pH of the iminodiacetate is sufficiently high at the time of mixing, as previously noted. If any small amounts of precipitates form they are readily dispersible and do not block orifices or plug lines.

The invention has been described with respect to examples and illustrations of embodiments thereof but is not to be considered as limited to them, since it will be clear to one of skill in the art how to substitute equivalents and modify the operations without departing from the spirit of the invention.

What is claimed is:

1. A method for the manufacture of composition of aqueous alkali metal silicate-imino salts selected from the group consisting of alkali hydroxy $C_2$–$C_4$ alkyl iminodiacetates and propionates which comprise admixing said imino salt at an elevated pH above the normal pH of said salt in water with a solution of the alkali metal silicate and producing therefrom an aqueous composition containing the said imino salt and the alkali metal silicate wherein the gellation and/or precipitation which would normally be obtained from admixing of the said components with the pH of the said imino salt unelevated is prevented or decreased, wherein the ratio to alkali metal oxide, $M_2O$ to $SiO_2$ in said alkali metal silicate is from 1:1.6 to 1:3.

2. A method according to claim 1 wherein the said imino salt is a diacetate at a pH less than before elevation thereof and the elevated pH is 12.5 or higher.

3. A method according to claim 1 wherein the admixing is effected at 50° to 80° C.

4. A method according to claim 1 wherein the imino salt is added to the alkali metal silicate.

5. A method according to claim 1 wherein the pH is elevated by addition to the imino salt before admixing with the alkali metal silicate of a base selected from the group consisting of alkali metal hydroxide and alkali metal carbonate.

6. A method according to claim 5 wherein the admixing is effected at 50° to 80° C.

7. A method according to claim 5 wherein the imino salt is disodium 2-hydroxyethyl iminodiacetate in solution at elevated pH and is added to the sodium silicate solution.

8. A method according to claim 3 wherein the aqueous composition also includes a synthetic organic detergent selected from the group consisting of anionic, nonionic and mixed anionicnonionic synthetic organic detergents.

9. A method according to claim 2 wherein the alkali metal silicate is of an $M_2O:SiO_2$ ratio in the range of 1:2 to 1:2.4, the imino salt is an alkali metal 2-hydroxyethyl iminodiacetate of a pH of 9 to 10 before elevation thereof and the alkali metal silicate and the alkali metal 2-hydroxyethyl iminodiacetate are in aqueous media before admixing.

10. A method according to claim 9 wherein the aqueous media are solutions, the temperatures of which are in the range of 20° to 80° C., when mixed, with the pH of the alkali metal 2-hydroxyethyl iminodiacetate solution being from 12.5 to 13.5 after elevation and before admixing with the silicate solution.

11. A method according to claim 10 wherein the alkali metal silicate is sodium silicate, the alkali metal 2-hydroxyethyl iminodiacetate is disodium 2-hydroxyethyl iminodiacetate and the temperatures of the solutions at the time of admixing are in the range of 50 to 80° C.

12. A method according to claim 11 wherein the concentration of the sodium silicate solution is from 20 to 50% of sodium silicate and that of the disodium 2-hydroxyethyl iminodiacetate is from 20 to 80% of disodium 2-hydroxyethyl iminodiacetate in the solution thereof.

13. A method according to claim 12 wherein the pH of the disodium 2-hydroxyethyl iminodiacetate solution is elevated by addition thereto of sodium carbonate before admixing with the aqueous sodium silicate solution.

14. A method according to claim 13 wherein the sodium silicate-disodium 2-hydroxyethyl iminodiacetate composition also contains nonionic and anionic synthetic organic detergents and organic gum antiredeposition agent.

15. A method according to claim 14 wherein the disodium 2-hydroxyethyl iminodiacetate solution at elevated pH is added to the sodium silicate solution.

16. A method according to claim 15 wherein the anionic detergent is a mixture of linear higher alkyl benzene sulfonate and higher fatty alcohol polyoxyethylene ethanol sulfate, nonionic detergent is linear higher alkyl polyoxyethylene ethanol and the antiredeposition agent is a carboxymethyl cellulose.

* * * * *